US007140703B1

(12) United States Patent
Holdgate, III et al.

(10) Patent No.: US 7,140,703 B1
(45) Date of Patent: Nov. 28, 2006

(54) PULL-OUT AND TILT GUIDE ASSEMBLY FOR A DRAWER

(76) Inventors: Edward Holdgate, III, 31 Bohenia Cir. South, Clearwater, FL (US) 33767; Mary Catherine Ziegler-Cannon, 31 Bohenia Cir. South, Clearwater, FL (US) 33767

( * ) Notice: Subject to any disclaimer, the term of this patent is extended or adjusted under 35 U.S.C. 154(b) by 0 days.

(21) Appl. No.: 11/214,662

(22) Filed: Aug. 30, 2005

Related U.S. Application Data

(60) Provisional application No. 60/522,314, filed on Sep. 14, 2004.

(51) Int. Cl.
*A47B 88/00* (2006.01)

(52) U.S. Cl. ..... 312/323; 312/330.1

(58) Field of Classification Search ..... 312/322, 312/323, 327, 328, 246, 334.7, 330.1; 248/291.1, 248/286.1, 284.1; 211/134, 187, 153
See application file for complete search history.

(56) References Cited

U.S. PATENT DOCUMENTS

| | | | | |
|---|---|---|---|---|
| 1,108,281 | A * | 8/1914 | Uffner | 312/323 |
| 1,213,121 | A * | 1/1917 | Mayne | 312/334.19 |
| 1,816,213 | A * | 7/1931 | Duke | 312/294 |
| 2,254,832 | A * | 9/1941 | Weight | 312/233 |
| 2,676,863 | A * | 4/1954 | Cooper | 312/246 |
| 2,839,349 | A | 6/1958 | Culver | |
| 4,314,734 | A | 2/1982 | Grunert | |
| 4,441,771 | A | 4/1984 | Roesler | |
| 4,725,108 | A | 2/1988 | Wilson | |
| 5,065,920 | A | 11/1991 | Amner | |
| 5,169,221 | A | 12/1992 | Wheeler | |
| 5,213,401 | A * | 5/1993 | Hatcher | 312/208.1 |
| 5,599,079 | A * | 2/1997 | Ranno et al. | 312/323 |
| 5,957,558 | A * | 9/1999 | Quade | 312/323 |
| 6,309,038 | B1 | 10/2001 | Domenig | |
| 6,846,052 | B1 * | 1/2005 | Kelley et al. | 312/208.1 |

FOREIGN PATENT DOCUMENTS

| | | | |
|---|---|---|---|
| EP | 658326 | * | 6/1995 |

* cited by examiner

*Primary Examiner*—Janet M. Wilkens

(57) ABSTRACT

A drawer assembly whereby an angular and horizontally configured guide slot is embedded on the guide brackets that produces a travel pattern. The drawer side panels have forward and rear cylindrical protrusions that engage the guide slot. The travel pattern is designed to control the drawer's position within the assembly and the forward and rearward range of movement. A decorator front panel provides a space for a handle and limits the rearward movement of the drawer. Removable stay pins in the guide slot stop the drawer from being unintentionally disengaged. A bottom stiffener at the rear of the assembly adds rigidity and also can support under counter lighting or other items.

2 Claims, 3 Drawing Sheets

1
3
4
6
7
8
9
11
12
13
14
15
17
18
A
B

Section A - A
1
2
3
4
9
11
12
13
15
16
17

Section B - B
1
3
5
6
7
8
9
10
11
18

See Fig 1, Section B - B

See Fig 1, Section B - B

PULL-OUT AND TILT GUIDE ASSEMBLY FOR A DRAWER

CROSS-REFERENCE TO RELATED APPLICATIONS

We hereby claim the benefit of an earlier filed application No. 60/522,314, filed Sep. 14, 2004, confirmation number 2314, titled: Under the cupboard kitchen silverware and knife drawer.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to the cabinetry art, and more particularly, a guidance and support assembly that is fastened to the underside of a cabinet, table or any other planer surface in which a drawer will pull outward and tilt downward.

2. Description of the Related Art Including Information Disclosed Under 37 CFR 1.97 and 1.98

Within limited accommodations, there is always a need for extra storage space. Recreational vehicles, marine applications, work shops or kitchens in a house are prime examples. In these environments, there are tables, wall cabinets and other types of structures which have a flush planar under surface or sometimes a recessed under surface that is located above the floor or countertop.

These structures can be utilized for creating additional storage by mounting a drawer assembly to their under surface. Since the location of this surface may cause this drawer to be positioned at a higher than normal level, it is desirable for this drawer to tilt downward to facilitate better visibility and access to it's contents. It is also desirable for this drawer to have the angle and degree of downward tilt controlled so as to inhibit the drawer's contents from spilling out. It is also desirable for this drawer to have a fluid low friction movement making it easy for everyone and in particular the elderly or disabled to operate. It is also important to prevent the drawer from being accidentally disengaged from it's embodiment but at the same time provide an easy way to remove the drawer for cleaning or other purposes. Preferably this assembly should be easy to mount to existing surfaces by relatively unskilled persons and be aesthetically adaptable to match or blend well with the design pattern of the existing decor. Additionally and ideally, it should be easy and inexpensive to incorporate into and as part of the original manufacture of the various structures it can be mounted to.

The concept of an under surface mountable drawer assembly with some form of tilt feature is known in prior art; however, the number of such drawer assemblies which are commercially available is limited. Most likely, the unavailability of this item is due to the complexities of the design and manufacturing requirements of prior art assemblies.

BRIEF SUMMARY OF THE INVENTION

The objective of the invention is improving a pull-out and tilt drawer assembly for a drawer which can, in our modern industrialized environment, be cheaply and efficiently produced using already well established technologies. This invention is suited to installations where there is an existing shelf, wall cabinet, table, or other type of furniture that has access to its lower planar or recessed surface and can be easily mounted by relatively unskilled persons. This invention is also suited to be easily and directly incorporated into the original manufacture of the various structures it can be mounted to such as wall cabinets or tables.

When used in conjunction with existing structures the embodiment consists of a top plate which insures the exact width of the drawer is maintained within its tolerance and which can be easily fastened to the lower surface of existing structures. Use of this plate also makes for easy installation even if the existing lower surface is recessed. A left side and right side guide bracket is mounted to this top plate. The side brackets have a single guide slot embedded in them that will insure the rigidity of the drawer movement at all times. At the bottom rear of the embodiment, a bottom stiffener is installed to increase rigidity and also provide a place to mount other items if desired such as under cabinet lighting or other apparatus such as a paper towel dispenser.

The drawer body, which consists of a parallel front and rear panel, a bottom panel and two evenly spaced parallel side panels, is designed to fit into the embodiment under close width, depth and height tolerances, and to maximize the amount of usable drawer storage area.

Attached to the drawer side panels are forward and rear cylindrical protrusions that engage the guide slot embedded in the side brackets and force the drawer to follow the exact travel pattern of the guide slot during any inward or outward movement. These cylindrical protrusions also provide for a fluid low friction movement of the drawer. The forward cylindrical protrusion also acts as positive stop at the fully open position.

The combination of the travel pattern of the guide slot in conjunction with the cylindrical protrusions, facilitate the spirit of this invention. When the drawer reaches its fully extended or open position, the forward cylindrical protrusion contacts an angular pathway in the travel pattern of the guide slot that inhibits further outward movement and the drawer rests securely at its fully extended and tilted position. In its open and tilted position, the drawer assembly facilitates better visibility and offers easy access to the contents therein. Stay pins are inserted within the guide slots to inhibit unintentional disengagement of the drawer from the guide brackets. If the stay pins are removed and it is desired to remove the entire drawer from the embodiment, a quasi vertical lifting of the drawer will easily disengage the forward cylindrical protrusions from the embodiment. Further extraction will result in the rear cylindrical protrusions disengagement and the drawer can be easily removed.

A decorator front panel that is aesthetically pleasing is installed to the front drawer panel. This panel is used to grasp the drawer or provide a surface to apply a means such as a knob or handle to grasp the drawer and also aids in the closing of the drawer by providing a limit stop when at the fully closed position.

In the case of recreational vehicles, marine applications or other situations which may warrant it, a commercially available latch or lock can be installed in the decorator front panel to prevent accidental opening or a security breach.

Installation of this drawer assembly would result in optimal use of available unused free space; provide ease of operation and installation through simplicity of design; allow an unobstructed line of site to the contents, and be of an overall convenience to the user.

BRIEF DESCRIPTION OF THE SEVERAL VIEWS OF THE DRAWINGS

In the following an exemplary embodiment of the invention will be described in conjunction with the Figures of the enclosed drawings in which.

DETAILED DESCRIPTION OF THE INVENTION

Figure 1:
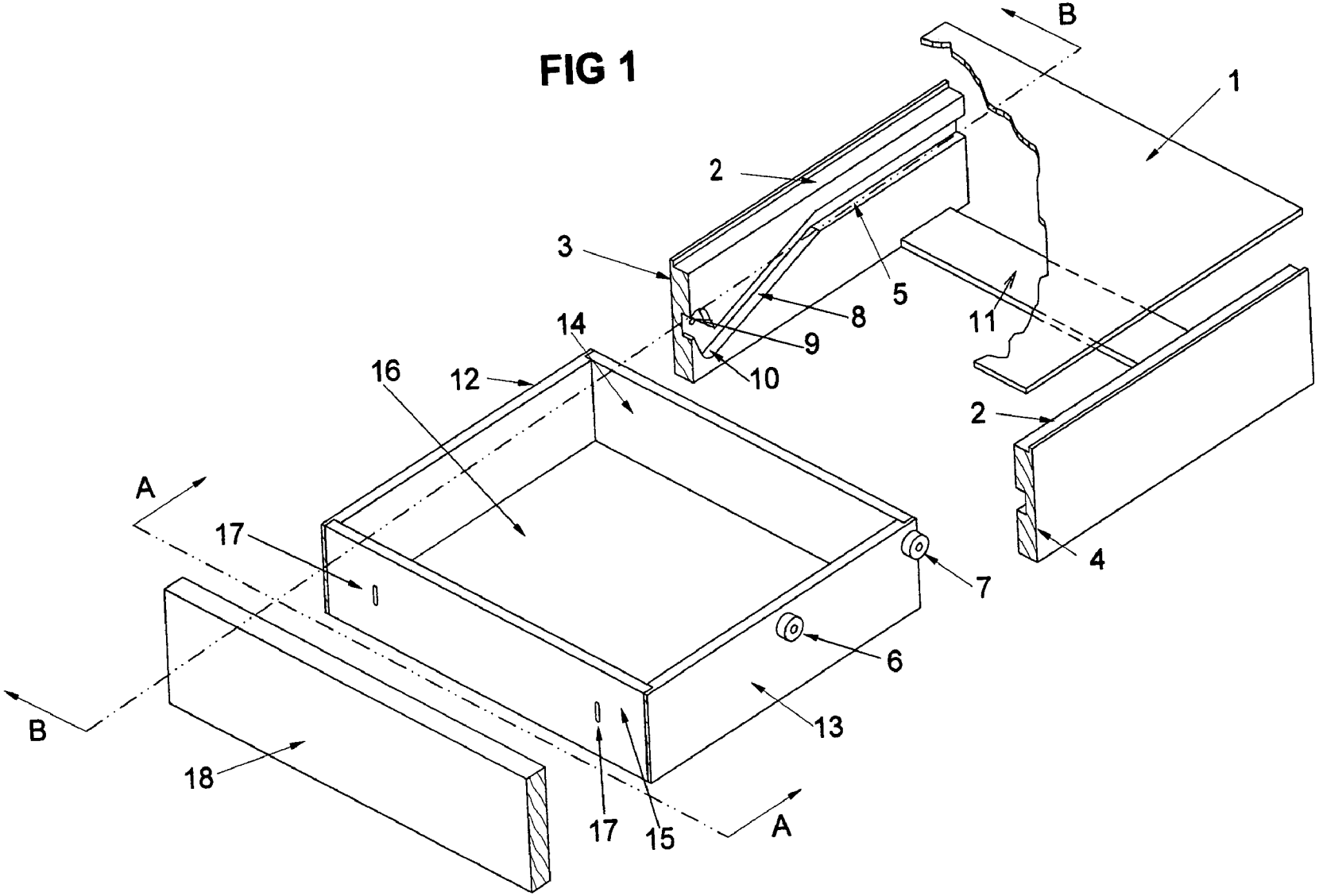
FIG. 1 Is an exploded view of a furniture body including the top plate (1), left and right top plate mounting step (2), the left and right guide brackets (3, 4), horizontal rest section (5), forward cylindrical protrusion (6), rear cylindrical protrusion (7), guide slot (8), stay pin (9), horizontal stop section (10), bottom stiffener (11), left and right side drawer panels (12, 13), rear drawer panel (14), front drawer panel (15), drawer bottom (16), mounting holes for decorator front panel (17), decorator front panel (18).

The preferred embodiment assembly of this invention, when used in conjunction with pre-existing structures is as shown in FIG. 1. This pull-out and tilt drawer assembly will mount to any planer surface including recessed types that are common on many cabinets. The top plate (1) is affixed to the side guide brackets (3 & 4) which include a top plate mounting step (2) cut to accept the top plate (1). The top plate (1) holds the width dimension for the drawer within acceptable ranges and is also used to hold the entire assembly square and rigid which results in unproblematic installation and operation of the drawer. This top plate (1) with the side guide brackets (3 & 4) attached is then attached to the underside of the cabinet or other suitable mounting location with screws or other fastening means.

The left and right side guide brackets (3 & 4) have a precision cut guide slot (8) embedded in them as shown in FIGS. 1, 4, 5 & 6 that assure the rigidity of the drawer movement at all times. The configuration of the guide slot (8) is referred to as the guide slot travel pattern.

This travel pattern, as defined from the front of the guide bracket (3 & 4) shown in FIGS. 1, 3 & 6, toward the rear of the guide bracket (3 & 4) is configured as follows:

First upon entering the guide bracket, the guide slot travel pattern travels at a slight upward angle, this section of the guide slot travel pattern is referred to as the entry angle; secondly, the guide slot travel pattern travels at a downward angle, this section of the guide slot travel pattern is referred to as the stop angle; thirdly, the guide slot travel pattern travels horizontally, this section of the guide slot travel pattern is referred to as the horizontal stop section (10); fourthly, the guide slot travel pattern travels at an upward angle this section of the guide slot travel pattern is referred to as the tilt angle; lastly, starting forward of the approximate center of the longitudinal axis of the guide slot the guide slot travel pattern travels horizontally and then exits the rear of the guide bracket, this section of the guide slot travel pattern is referred to as the horizontal rest section (5).

The drawer body as shown in FIG. 1, which consists of a front drawer panel (15) a parallel rear drawer panel (14) a drawer bottom (16) and two evenly spaced parallel side drawer panels (12 & 13), is designed to fit into the embodiment under close width, depth and height tolerances. A forward cylindrical protrusion (6) and a rear cylindrical protrusion (7) is affixed to the exterior of each of the drawer side panels as shown in FIG. 1. The design of these protrusions may be in the form of a dowel or a roller formed of metal, nylon, rubber or other appropriate material.

Figure 5:
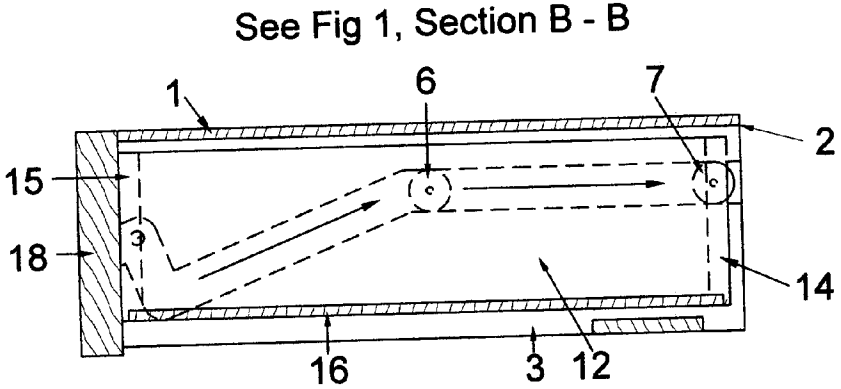

The forward and rear cylindrical protrusions (6 & 7) on the drawer engage the guide slot (8) travel pattern embedded into the left and right guide brackets (3 & 4). This travel pattern allows the drawer to follow the exact travel pattern of the guide slot (8) as shown in FIGS. 5 & 6. The travel pattern angles of the guide slot (8) are defined by the dimensions of the cabinet it is being applied to. Location of the forward cylindrical protrusion (6) on the drawer also affects the symmetry of its movement.

By changing the placement of the forward cylindrical protrusion (6) on the drawer, the angle of tilt can be modified as well as length of pullout. By changing the tilt angle on the side bracket guide slot (8), the travel pattern can also be modified in both degree of tilt and length of pullout.

The drawer is considered in its closed position when it is fully within the embodiment and the forward and rear cylindrical protrusions (6 & 7) are resting on the horizontal rest section (5) of the guide slot (8) as shown in FIG. 5. When the drawer is extracted and reaches its fully extended or open position as shown in FIG. 6, the forward cylindrical protrusion (6) encounters the horizontal stop section (10) in the guide slot (8) that stops further outward or opening movement and the drawer rests securely at its fully open, extended and tilted position.

Figure 3:
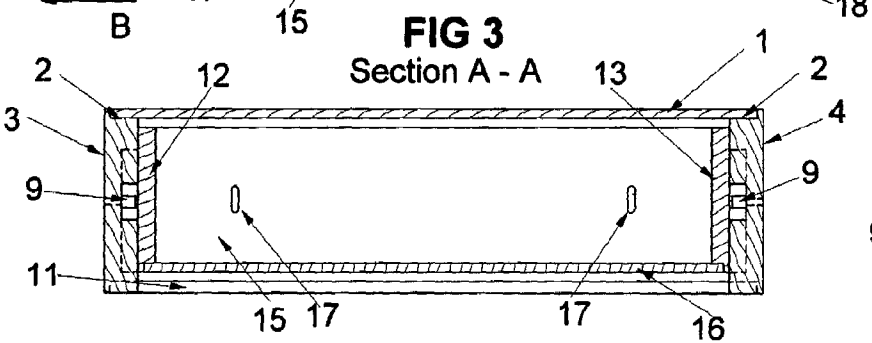
FIG. 3 Is a sectional view at section A—A FIG. 1, of the top plate (1), left and right top plate mounting steps (2), the left guide bracket (3), the right guide bracket (4), the stay pins (9), the bottom stiffener (11), the left side drawer panel (12), the right side drawer panel (13), the front drawer panel (15), the drawer bottom (16), the mounting holes for decorator front panel (17).
Figure 4:
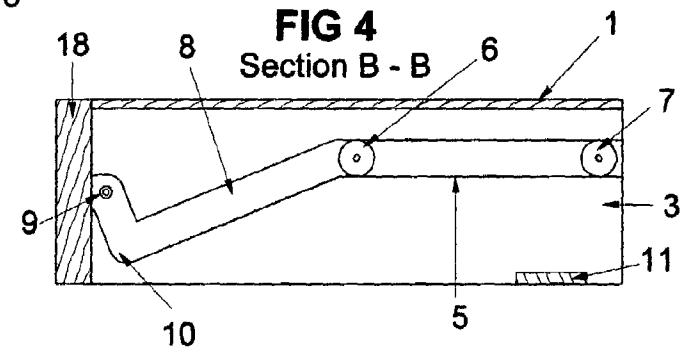
FIG. 4 Is a sectional view at section B—B FIG. 1, of the drawer in the closed position showing the top plate (1), the left bracket (3), the horizontal rest section (5), the forward cylindrical protrusion (6), the rear cylindrical protrusion (7), the guide slot (8), the stay pin (9), the horizontal stop section (10), the bottom stiffener (11), FIG. 5 Is a sectional view at section B—B FIG. 1, of the drawer installed in the closed position. An outline of the installed drawer is shown for clarity and includes the top plate (1), the left top plate mounting step (2), the left guide bracket (3), the forward cylindrical protrusion (6), the rear cylindrical protrusion (7), the left side drawer panel (12), the rear drawer panel (14), the front drawer panel (15), the drawer bottom (16), the decorator front panel (18).
Figure 6:
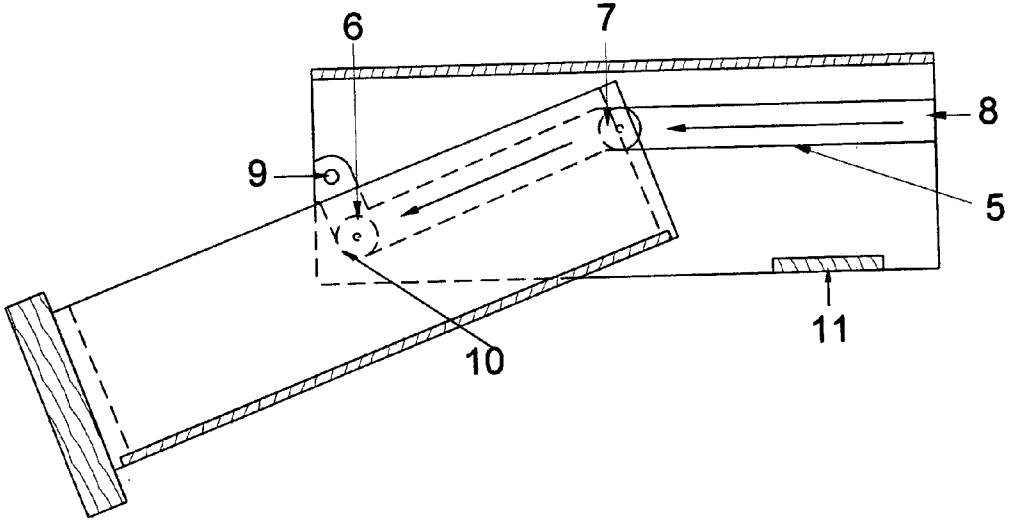
FIG. 6 Is a sectional view at section B—B FIG. 1, of the drawer installed in the open position. An outline of the installed drawer is shown for clarity. It includes the horizontal rest section (5), the forward cylindrical protrusion (6), the rear cylindrical protrusion (7), the guide slot (8), the stay pin (9), and the horizontal stop section (10).

A stay pin (9), constructed of metal, wood, plastic, nylon or other appropriate material and defined as a cylindrical pin the size of which is less than the width of the guide bracket, the diameter of which is smaller than the width of the guide slot and the length of which is long enough to protrude into the guide slot when inserted into the stay pin hole without interfering with the movement of the drawer, is disposed in the guide slot of each guide bracket at the position shown in FIGS. 3, 4 & 6 to deter unintentional removal of the drawer. If the stay pins (9) are removed and it is desired to remove the entire drawer from the embodiment, a quasi vertical lifting of the drawer will easily disengage the forward cylindrical protrusions (6) from the embodiment. Further extraction will result in the rear cylindrical protrusions (7) disengagement and the drawer is removed.

Figure 2:
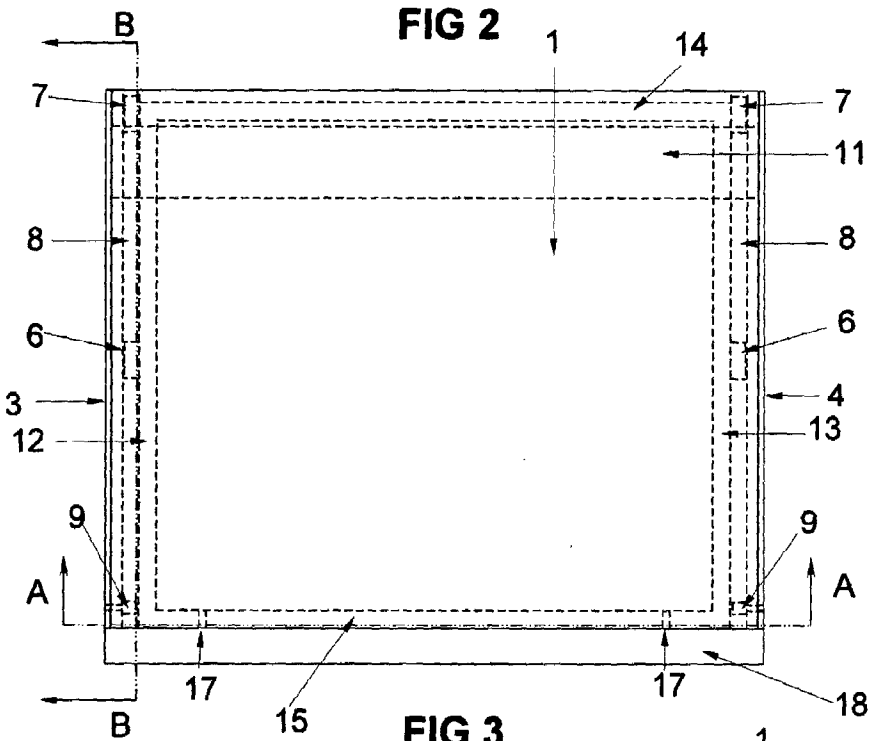
FIG. 2 Is a top view of the drawer embodiment showing the top plate (1), the left and right guide brackets (3, 4), the forward cylindrical protrusion (6), the rear cylindrical protrusion (7), the guide slot (8), the stay pin (9), the bottom stiffener (11), the left side drawer panel (12), the right side drawer panel (13), the rear drawer panel (14), the front drawer panel (15), the mounting holes for the decorator front panel (17), the decorator front panel (18).

A decorator front panel (18) is installed on the front drawer panel (15) through the mounting holes for decorator front panel (17) shown in FIGS. 1, 2 & 3. The mounting holes for the decorator front panel (17) are elongated to allow for proper vertical positioning of the decorator front panel (18). The decorator front panel (18) can be finished in any type of finish and or design or a commercially available drawer front panel may be used to match the decor of the structure this assembly is mounted to. The decorator front panel (18) is used to grasp the drawer or provide a surface to apply a means such as a knob or handle to grasp the drawer and also aids in the closing of the drawer by providing a limit stop when at the fully closed position. In the case of recreational vehicles, marine applications or other situations which may warrant it, a commercially available latch or lock can be installed in the decorator front panel (18) to prevent accidental opening or a security breach.

At the bottom rear of the embodiment, a bottom stiffener (11) is installed to increase rigidity as shown in FIGS. 1, 5 & 6) and also provide a place to mount under cabinet lighting or other apparatus such as a paper towel dispenser.

On some installations where the back of the drawer body can be seen, such as an island or pass through, a decorator back plate matching the existing cabinet decor is installed for esthetic purposes.

The preferred materials for each part of the invention include wood, plywood, plastic, metal or other appropriate material depending on the structure and the location of the structure, including exposure to various climatic conditions, that this invention is being incorporated within. The type of materials used for this invention when installed in a residential kitchen environment can vary considerably from those selected when the intent is to install this invention in a salty, humid marine environment.

In summary, it should be realized that the intent and purview of the present invention is to utilize the concept thereof in virtually any conceivable construction involving storage. When this invention is incorporated into and as part of the original manufacture of various structures the top plate (1) can be eliminated and the guide slots can be inserted directly into the sidewalls of the structure at the factory, by design, and at negligible cost.

With respect to the above description then, it is to be realized that the optimum dimensional relationships for the parts of the invention to include variations in size, materials, shape, form function and manner of operation, assembly and use, are deemed readily apparent and obvious to one skilled in the art, and all equivalent relationships to those illustrated in the drawings and described in the specification are intended to be encompassed by the present invention.

Therefore, the forgoing is considered as illustrative of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

DRAWING LEGEND

1. Top plate
2. Left and right top plate mounting step
3. Left guide bracket
4. Right guide bracket
5. Horizontal rest section
6. Forward cylindrical protrusion
7. Rear cylindrical protrusion
8. Guide slot
9. Stay pin
10. Horizontal stop section
11. Bottom stiffener
12. Left side drawer panel
13. Right side drawer panel
14. Rear drawer panel
15. Front drawer panel
16. Drawer bottom
17. Mounting holes for decorator front panel
18. Decorator front panel

The invention claimed is:

1. A drawer and pull-out and tilt guide assembly comprising:

a top plate coupled to and between a pair of substantially parallel spaced-apart side guide brackets, each of said guide brackets having substantially planar exterior surface and an inner surface, with each inner surface having a guide slot embedded within, with each guide bracket to be a mirror image of the other;

a bottom stiffener coupled to the bottom of and between said guide brackets;

a drawer having a front drawer panel and a back drawer panel being interconnected by a pair of spaced-apart side drawer panels with the panels forming an internal compartment, each side drawer panel having an exterior surface with a forward cylindrical protrusion and a rear cylindrical protrusion coupled thereto, wherein the forward cylindrical protrusion is positioned parallel to the rear cylindrical protrusion, the cylindrical protrusions being engaged within the guide slot of a respective said bracket, with the drawer having a decorator front panel coupled to the front drawer panel, wherein said decorator front panel functions to provide a limit stop for the drawer at a fully closed position;

guide each bracket having a cylindrical stay pin with an associated stay pin hole located in the center of the said guide slot at the intersect point of an entry angle and a stop angle, the diameter of the cylindrical stay pin being smaller than the width of the guide slot, the length of the cylindrical stay pin being less than the width of the guide bracket and sized to protrude into the guide slot without protruding beyond it, when the cylindrical stay pin is inserted into the stay pin hole.

2. A drawer and pull-out and tilt guide assembly, comprising:

a top plate coupled to and between a pair of substantially parallel spaced-apart side guide brackets, each of said guide brackets having a substantially planar exterior surface and an inner surface, with each inner surface having a guide slot embedded within, with each guide bracket to be a mirror image of the other;

a bottom stiffener coupled to the bottom of and between said guide brackets;

a drawer having a front drawer panel and a back drawer panel being interconnected by a pair of spaced-apart side drawer panels with the panels forming an internal compartment, each side drawer panel having an exterior surface with a forward cylindrical protrusion and a rear cylindrical protrusion coupled thereto, wherein the forward cylindrical protrusion is positioned parallel to the rear cylindrical protrusion, the cylindrical protrusions being engaged within the guide slot of a respective said bracket, with the drawer having a decorator front panel coupled to the front drawer panel, wherein said decorator front panel functions to provide a limit stop for the drawer at a fully closed position;

the drawer being coupled to the guide slots of the guide brackets, with the cylindrical protrusions follow following the guide slot travel pattern until said the forward cylindrical protrusions are located at the point of intersect between a horizontal stop section and a stop angle of a respective said bracket;

the drawer having a fully opened position wherein a stay pin hole is located in the center of each said guide slot at the intersect point of the entry angle and the stop angle, the stay pin being coupled with the stay pin hole to prevent the drawer from accidental disengagement from the guide assembly, with the stay pin being removable so as to allow removal of the stay pin from the guide bracket thereby facilitating drawer removal.

* * * * *